United States Patent [19]

Prodel

[11] Patent Number: 4,538,742

[45] Date of Patent: Sep. 3, 1985

[54] PLASTIC BOTTLE CASE AND BOTTLE PACKAGING WITH SUCH CASE

[76] Inventor: Ulrich H. Prodel, 13 Gruenstr., Badsalzulften, Fed. Rep. of Germany

[21] Appl. No.: 494,303

[22] Filed: May 13, 1983

[30] Foreign Application Priority Data

May 13, 1982 [DE] Fed. Rep. of Germany ..... 3218075

[51] Int. Cl.[3] ..... B65D 1/24

[52] U.S. Cl. ..... 220/21; 206/427

[58] Field of Search ..... 220/21; 206/427, 140

[56] References Cited

U.S. PATENT DOCUMENTS

| | | | |
|---|---|---|---|
| 3,679,121 | 7/1972 | Morgese | 206/140 |
| 4,032,007 | 6/1977 | Graser | 206/427 |
| 4,036,391 | 7/1977 | Prodel | 220/21 |
| 4,071,162 | 1/1978 | Steinlein | 220/21 |
| 4,269,309 | 5/1981 | Prodel | 220/21 |
| 4,295,576 | 10/1981 | Steinlein | 220/21 |
| 4,308,966 | 1/1982 | Ettema | 220/21 |

FOREIGN PATENT DOCUMENTS

| | | | |
|---|---|---|---|
| 2556449 | 6/1977 | Fed. Rep. of Germany | 220/21 |
| 2635754 | 2/1978 | Fed. Rep. of Germany | 220/21 |
| 1432326 | 2/1966 | France | 206/508 |
| 979205 | 1/1965 | United Kingdom | 220/21 |

*Primary Examiner*—George E. Lowrance

*Attorney, Agent, or Firm*—Robert E. Burns; Emmanuel J. Lobato; Bruce L. Adams

[57] ABSTRACT

In a plastic case for individual bottles or bottles in cardboard carriers, the bottles are positioned slightly spaced from one another in straight lines by columns projecting up from the bottom of the case. Except at ends of the case, the columns are arranged in pairs with the two columns of a pair spaced apart to receive the sides of bottle carriers between them. At the ends of the case, there are single columns spaced from the end walls to receive the sides of bottle carriers. Each column is of T-shape or Y-shape in cross section, formed of two sides joined in an acute angle. Each side is formed of two wall portions disposed at an obtuse angle to one another. At the three corners of each column there are rounded beads which engage cylindrical surfaces of the bottles to position them. On the side walls in line with rows of columns there are rounded beads on inwardly projecting ribs. At the corners of the case there are strong double wall columns which constitute load-supporting elements when the cases are stacked.

15 Claims, 12 Drawing Figures

PLASTIC BOTTLE CASE AND BOTTLE PACKAGING WITH SUCH CASE

FIELD OF INVENTION

The present invention relates to a plastic case or crate for holding bottles and to the packaging in such crate of two or more groups of bottles contained in paper or cardboard bottle carriers.

BACKGROUND OF INVENTION

A bottle case of this category is known through DE-OS No. 2914993. The advantage of such case is that bottle carriers of paper or cardboard containing groups of bottles can be placed in the bottle case so that bottle carriers for one or more rows of bottles can be used. For spaces between bottles such bottle carrier has only bottom openings with no cut-outs in the sidewall. This is very beneficial to the stability of the bottle carrier and moreover, the sidewalls of the bottle carrier provide advertising surfaces throughout the circumference.

Existing bottle cases for twenty Euro-bottles of a diameter of 70.5 mm in which the bottles are arranged in five rows of four bottles each have outside dimensions of 400 mm×330 mm. The present invention is directed to solution of the problem that with the bottles standing in straight rows, the outside dimensions of the case can be reduced to 400 mm×300 mm so that the bottle cases can be closely stacked when using pallets of normal dimensions. Efforts to solve this problem have been made from many sides. Heretofore, all efforts to arrange the bottles in straight rows have failed because the sidewalls of the bottle case must be made too thin. Such a case can be constructed and also produced but will not withstand the rough treatment to which bottle cases are subjected not only in packing and unpacking machines but also in transport and in being piled high in storage. The insufficient stability of the very thin sidewalls cannot be avoided through special stabilizing measures, such for example as a special formation of the dividing walls inside the case and special construction of the joining of these dividing walls with the side walls. This results in a bottle case in which in the inside of the case the bottle spaces are not arranged in a straight row. Through Honeycomb arrangement of the dividing walls inside the bottle case, sufficient stability of the side walls and width of 300 mm can be obtained, but this arrangement of the bottle cases not in a straight line has the objection that the gripping heads in the packing and unpacking machines must be altered and then difficulties arise in gripping bottles fed to the packing machine in straight lines.

SUMMARY OF THE INVENTION

It is an object of the present invention to provide a bottle case in which, at least in the rows parallel to the end walls of the bottle case, the bottles are positioned extraordinarily close to one another without touching.

The invention solves this problem by departing from the above mentioned prior art in that each of the columns for positioning the bottles is triangular with two corners arranged on the side toward the adjacent column of a column pair while the third corner lies on an imaginery line which is perpendicular to a line joining the other two corners, that each column is formed of two walls bent at an obtuse angle which, on the side facing away from the space between two columns of a column pair come together at an acute angle, and that each corner is provided with a bead which extends perpendicularly to the bottom of the case.

When it is desired to have bottles very close together in rows parallel to the end walls of a bottle case, it is not possible to have partitions in the case because partitions, on account of the required play between them and the bottle circumference, require three times as much space as the minimum distance between bottles without partitions. In accordance with the invention minimum spacing is obtained through the design of the spacing columns as two walls bent at an obtuse angle the walls furthermore being reinforced by three beads extending perpendicular to the bottom of the case. Through this particular form of the columns, it is possible to reduce the spacing between individual bottles to about 0.5 mm and to maintain this spacing under the dynamic loading imposed on the bottles during transport. The bottles thus stand very close together without touching. Moreover with the construction in accordance with the invention, there is the advantage that individual bottles as well as bottles in bottle carriers with the desired number of rows can be packaged in the case.

For a high stability of the bottles which are arranged directly adjacent the end walls, it is especially advantageous to provide inside each end wall a row of single columns which are aligned with the rows of column pairs inside the case and which have the apex of the angle-form cross section directed toward the inside of the case.

To provide good stability for the bottles adjacent the long sides of the case, it is desirable to provide inside of the side walls pairs of ribs with the mid point between the ribs of a pair aligned with the column pairs inside the case.

Through the characteristics of a bottle case in accordance with the invention it is possible to produce a stable case which meets all of the usual stability requirements and which the area is not greater than 300 mm×400 mm with a straight line arrangement of rows of 4×5 Euro-bottles having a diameter of 70.5 mm. Moreover the characteristics of this bottle case can be used to produce a bottle packaging of these small dimensions not only for individual bottles but also for bottles in bottle carriers of at least one row in the bottoms of which openings are provided to receive the column-form spacing elements of the bottle case. This bottle packaging is characterized by the combination of the following features:

1. In each row of bottle receiving positions, the bottle receiving positions are defined by column-form spacing bodies so as to have a separation of from 0.5 to 1.5 mm.

2. Each of the spacer bodies comprises two columns which are turned 180° to one another and spaced from one another and terminate in roof-form surfaces. The columns are so arranged that the space between the two columns of a column pair lies on an imaginery line which runs between two rows of bottle positions.

3. Each column has a V-form or Y-form angle cross sections.

4. Each of the columns is triangular with two corners on the side facing the adjacent column of a column pair while the third corner lies on an imaginery line which is perpendicular to a line connecting the two other corners.

5. Inside each end wall, there is a row of single columns which are aligned with the rows of column pairs in the case.

6. The corners of the bottle case are formed as hollow corner columns of which continuous inner walls arranged in the column adjacent the side wall partially surround the adjacent bottle position.

7. Each cardboard bottle carrier is rounded on its vertical corner at least in the region of the bottom and is provided with flaps which partially surround the end or corner bottles at the end of the carrier, at least in the region of the bottom.

This bottle packaging is characterized in that the bottles are prevented from touching one another during transport in bottle carriers or as individual bottles while maintaining the outside dimension of 300 mm×400 mm with full stability of the bottle case.

The bottle case of this bottle packaging contains its high stability partially through the corner columns. Therefore, it is desirable for the corner columns of the bottle case to project above the upper edges of the side walls and or to project below the lower edges of the side walls and the bottom. Thus when bottle cases are stacked, the loading is taken only by the corner columns.

In order to facilitate the stacking of the bottle cases and thereby assure that the bottle cases of a stack do not become laterally displaced relative to one another, it is desirable for the upper ends of the corner columns to be provided with offsets which are closed by a square, flat surface.

When the spacing columns have an angle cross section, it is desirable for each column of angle cross section to be formed of two wall portions at an obtuse angle to one another with the apex of the angle directed toward the side of the column facing the other column of a column pair. In this manner, the column is provided with advantageous stability against vertical loads.

It is advantageous when on the inside of side walls of the bottle case there are provided pairs of ribs spaced equally from an imaginery line passing through the spaces between the columns of a row of column pairs. These ribs give the side walls stability and at the same time provide positioning and stability for the bottles.

BRIEF DESCRIPTION OF DRAWINGS

The nature and advantages of the invention will be more fully understood from the following description of preferred embodiments shown by way of example in the drawings in which.

DESCRIPTION OF PREFERRED EMBODIMENTS

Figure 1:
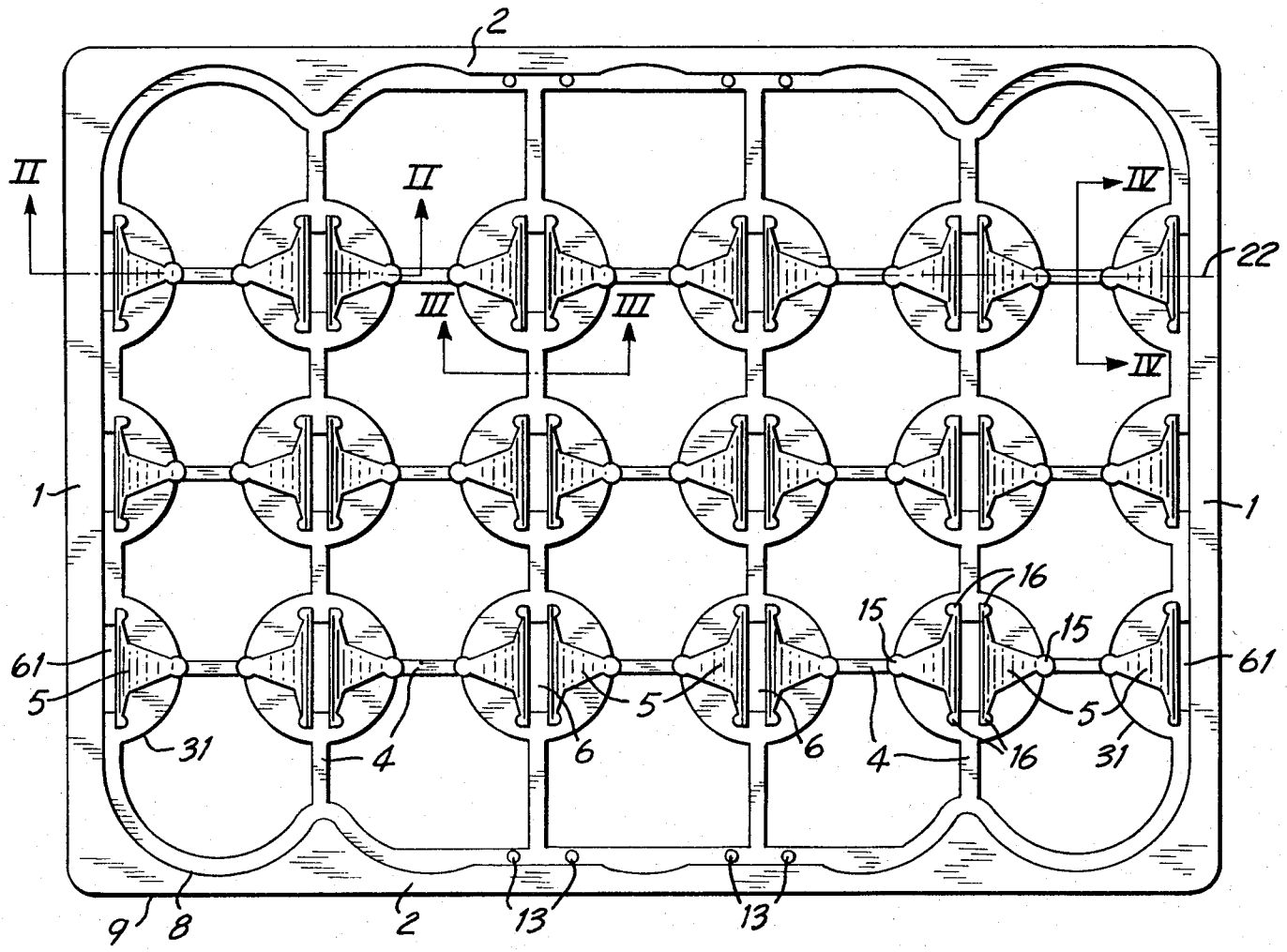
FIG. 1 is a top plan view of a bottle case in accordance with the invention.

A bottle case in accordance with the invention as shown by way of example in the drawings comprises end walls 1 and long side walls 2 as well as a bottom which is formed of circular webs 3 and straight webs 4. The circular webs 3 are connected with one another by straight webs 4 running parallel to the side walls. Further straight webs 4 connect with the side walls 2. On each end wall, there are semi-circular webs 31 connected to adjacent circular webs 3 by straight webs 4. The circular webs 3 and semi-circular webs 41 carry bottle spacing members in the form of columns 5. The columns 5 on circular webs 3 are arrange in pairs with the two columns of a pair spaced apart from one another to define between them a space 6 to receive the side walls of a bottle carrier when the bottles are packaged in carrier. At their lower ends, the two columns 5 of a pair are connected with the circular web 3 by a flat horizontal surface 7. In a corresponding manner, the single columns 5 on the semicircular webs 31 are spaced inwardly from the end walls of the bottle case to provide spaces 61 to receive a side wall of bottle carrier between the end wall of the bottle case and the single columns 5. At their lower ends the single columns 5 are joined with the semi-circular webs 31 by flat horizontal semi-circular surfaces 32.

Figure 5:
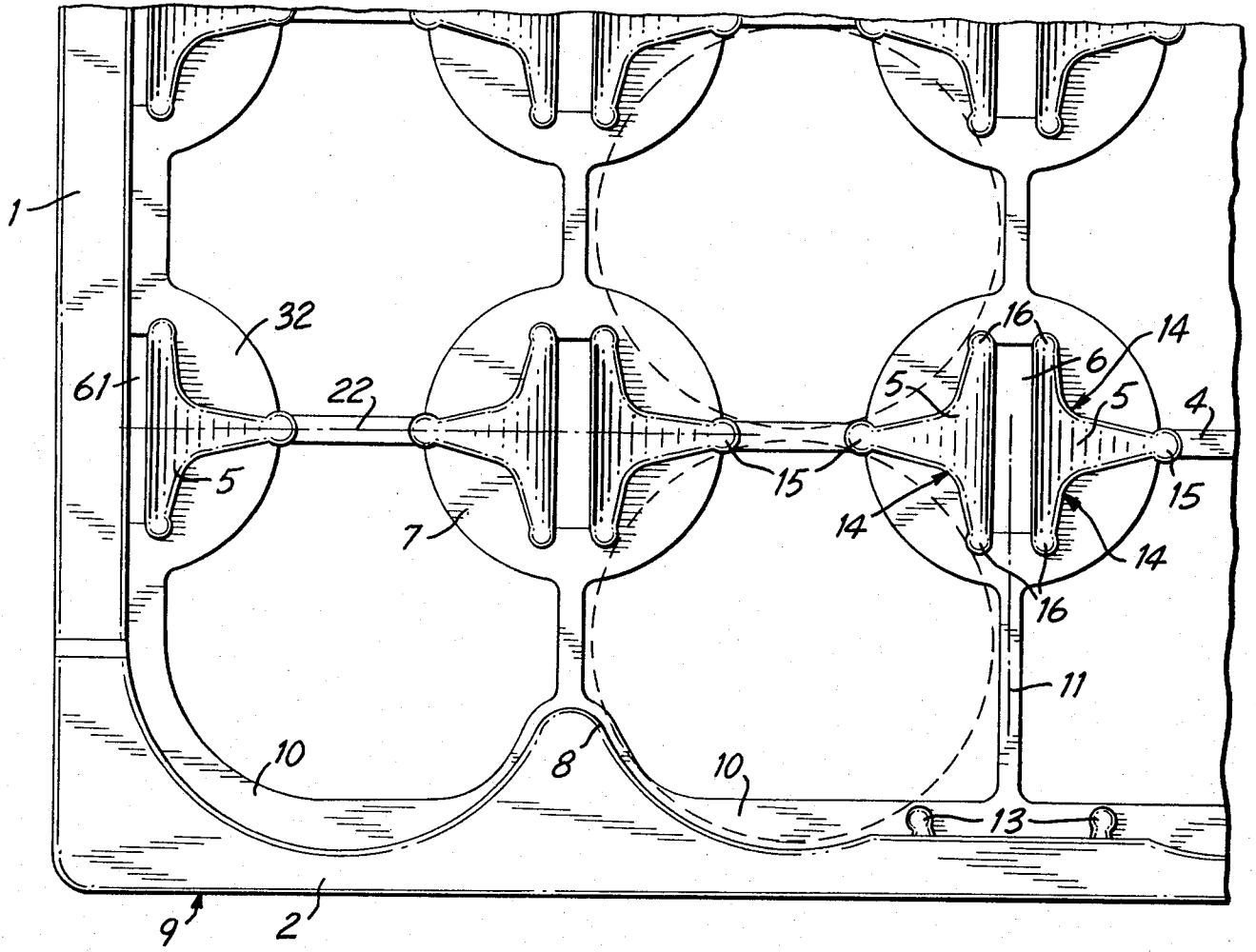
FIG. 5 is a top plan view on a larger scale of a quarter of a bottle case.
Figure 6:
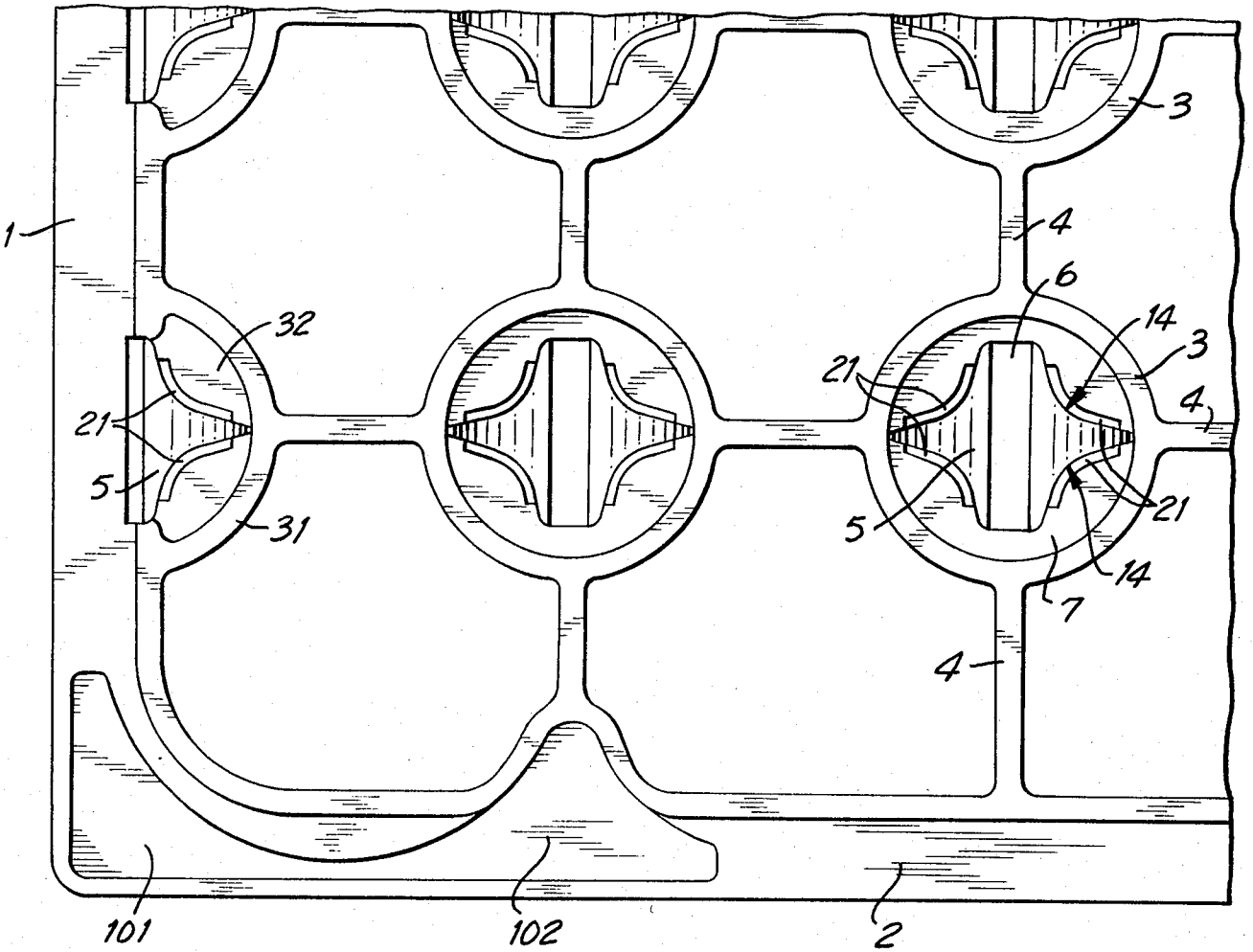
FIG. 6 is a bottom view of a quarter of a bottle case.

In order to give the bottle case sufficient stability, the corners are made particularly strong. This is achieved in the manner that the corner of the bottle case is formed as a double wall corner column comprising an inner wall 8 and an outer wall 9 enclosing a cavity formed of two parts 101 and 102 which can be connected with one another of which the part 101 lies directly in the corner while the cavity portion 102 extends along the side wall and has a wedge-shaped between the two end bottles in the corner of the bottle case along the side wall. The inner wall 8 has along its lower edge a horizontal surface 10 for supporting a bottle shown in broken lines in FIG. 5.

Figure 7:
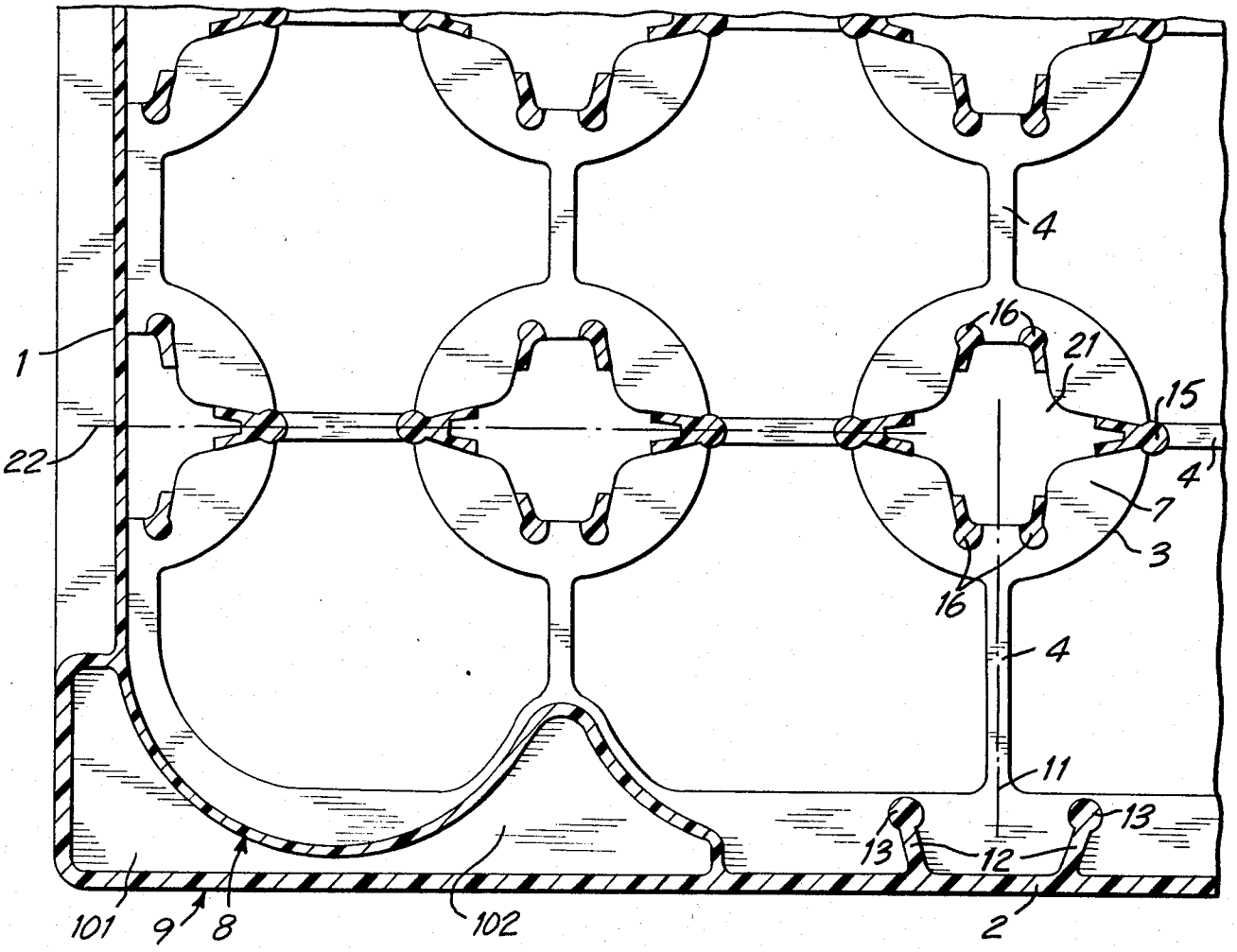
FIG. 7 is a horizontal section through a quarter of a bottle case above the bottom of the case.

Centered on the center line 11 of the space 6 between the pairs of columns 5, a pair of vertically extending ribs 12 are provided on the inside of the side walls of the bottle case. As seen in FIG. 7 the ribs 12 are inclined at an angle to the side wall and are formed with vertically extended beaded edges 13.

Figure 4:
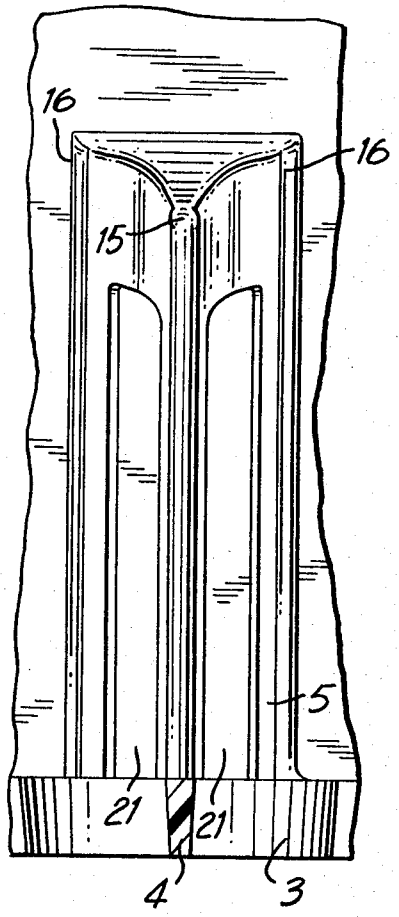
FIG. 4 is a partial vertical section taken on the line IV—IV in FIG. 1.
Figure 3:
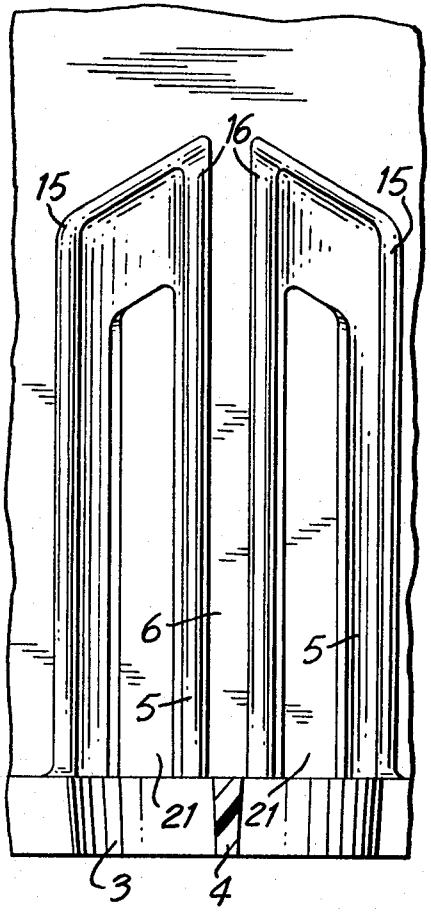
FIG. 3 is a partial vertical section on the line 3—3 in FIG. 1.
Figure 2:
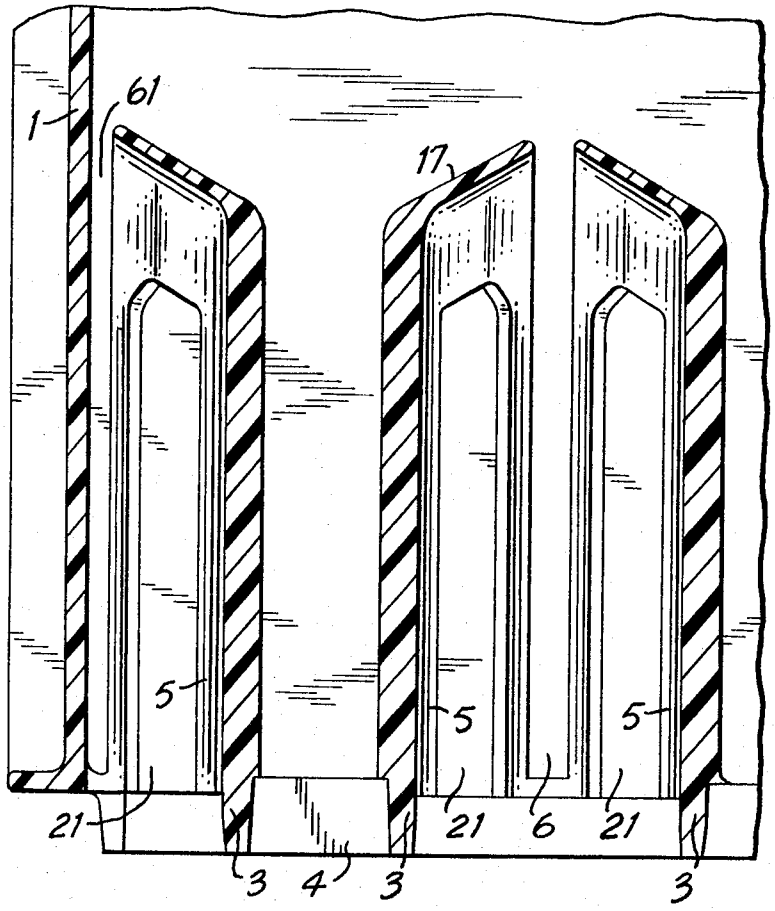
FIG. 2 is a cross section through spacing bodies along the line II—II in FIG. 1.

Each of the columns 5 is T-shaped or Y-shaped in cross section, being formed with two sides which join one another in an acute angle which is directed away from the space between the two columns of a pair. Each side of the column is formed of two wall portions 14 disposed at an obtuse angle to one another, the vertex of an angle being directed inwardly so that the sides are in effect concave. Each column in cross section thus has three corners of which one is at the vertex of the angle between the two sides while the other two corners are at the edges of the sides adjacent the space 6 between the two columns of a pair. At the corner which is at the apex of the angle between the two sides, there is an enlarged rounded bead 15 (FIG. 7). At the other two corners, there are enlarged rounded beads 16 which in effect define the space between the two columns of a pair. In order to save weight and material, the sides of the columns have narrow elongate openings 21 as seen in FIGS. 2, 3, and 4. At their upper ends, the columns terminate in a sloping roof 17 which assists in guiding the bottles into the bottle receiving positions between the columns. As will be seen from FIGS. 2, 3 and 4, the height of the columns is less than that of the side walls and end walls of the bottle case and is preferably approximately equal to the height of the body portion of the bottles -below the neck-which the bottle case is designed to receive.

Figure 9:
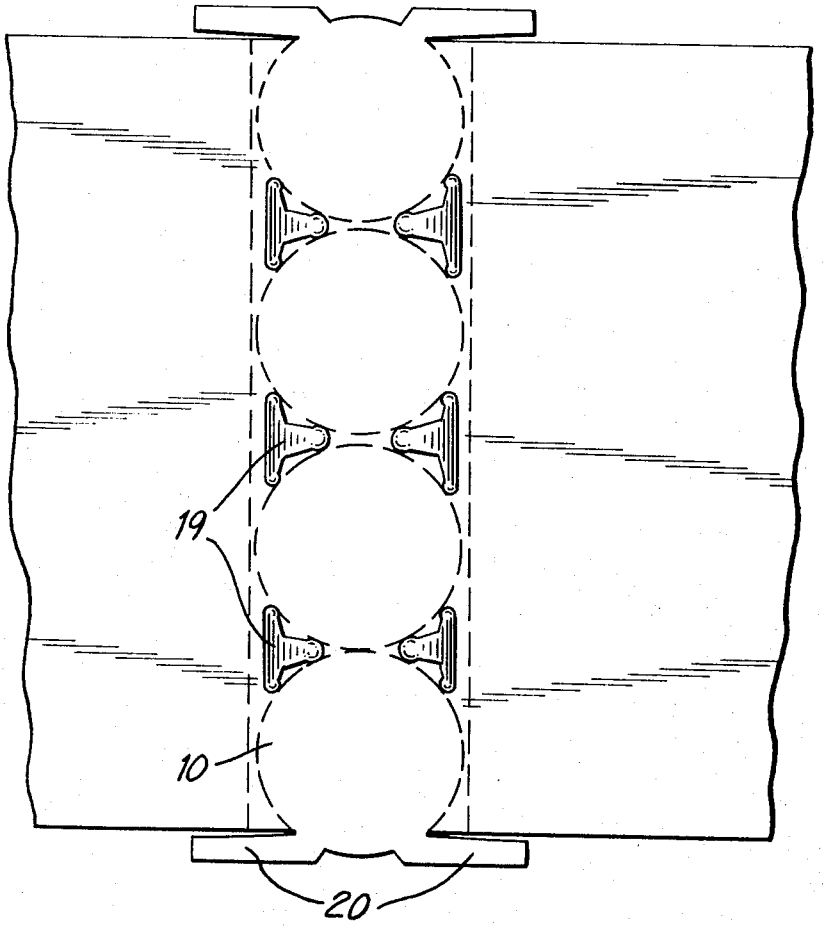
FIG. 9 is a partial schematic view of the sheet material of which the bottle carrier of FIG. 8 is formed.
Figure 8:
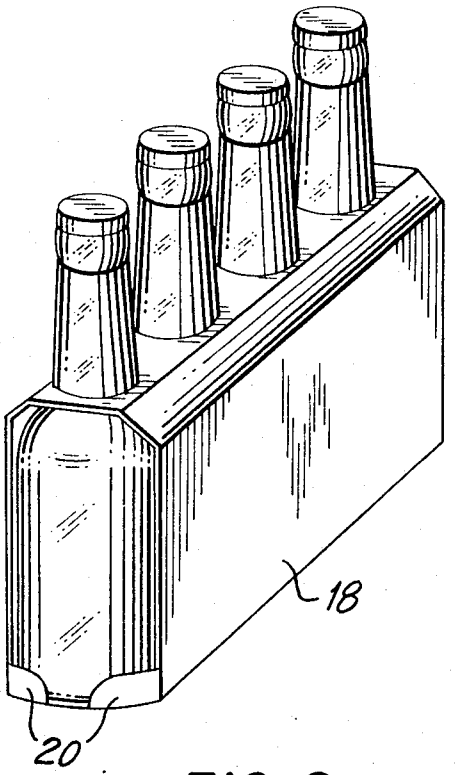
FIG. 8 is a schematic perspective view of a single row bottle carrier containing four bottles.
Figure 11:
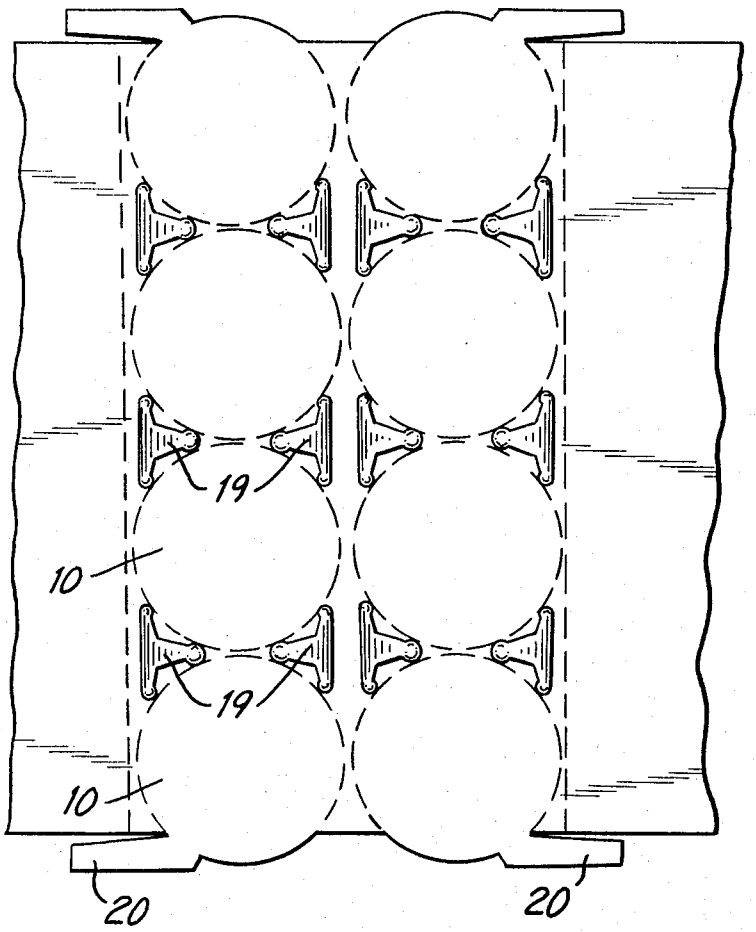
FIG. 11 is a partial schematic view of sheet material from which the bottle carrier of FIG. 10 is formed and FIG. 12 is a schematic side elevation of the bottle case of FIG. 1
Figure 10:
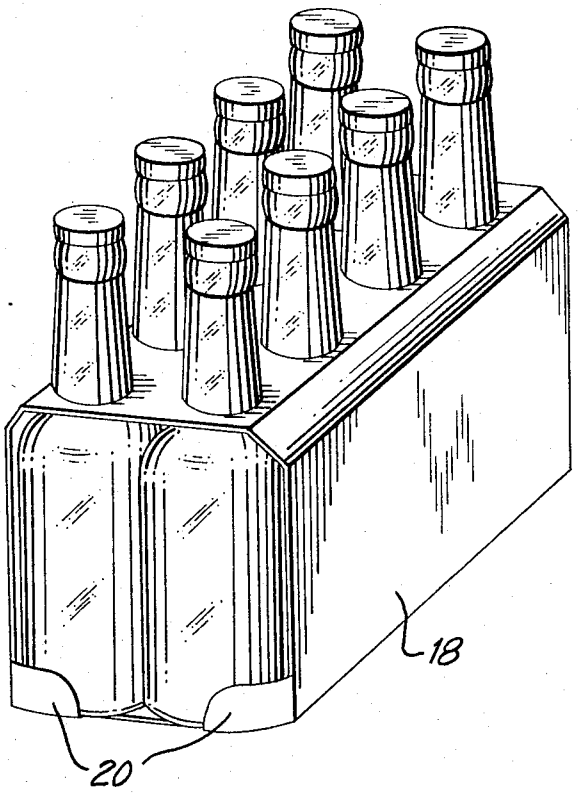
FIG. 10 is a schematic perspective view of a two row bottle carrier containing eight bottles.

The bottle case will receive either individual bottles or bottles packaged in bottle carriers such as those illustrated by way of example in FIGS. 8 to 11. FIGS. 8 and 9 show a single row bottle carrier for four bottles while FIGS. 10 and 11 show a two-row carrier for eight bottles. The bottle carriers are conveniently formed of sheet material such as heavy paper, cardboard or plastic. Each of the bottle carriers 18 is provided in its bottom with openings 19 for entry of the columns 5 when the bottle carrier with bottles therein is inserted in the bottle case. At the ends of the bottom, there are flaps 20 which, after the bottles have been placed on the bottom, are folded up and pressed against the cylindrical part of the bottle wall before the side walls of the carrier are folded up. In this manner, the corners of the bottle carrier are somewhat rounded so that the bottle carrier can be readily inserted in a bottle case of the kind illustrated.

Figure 12:
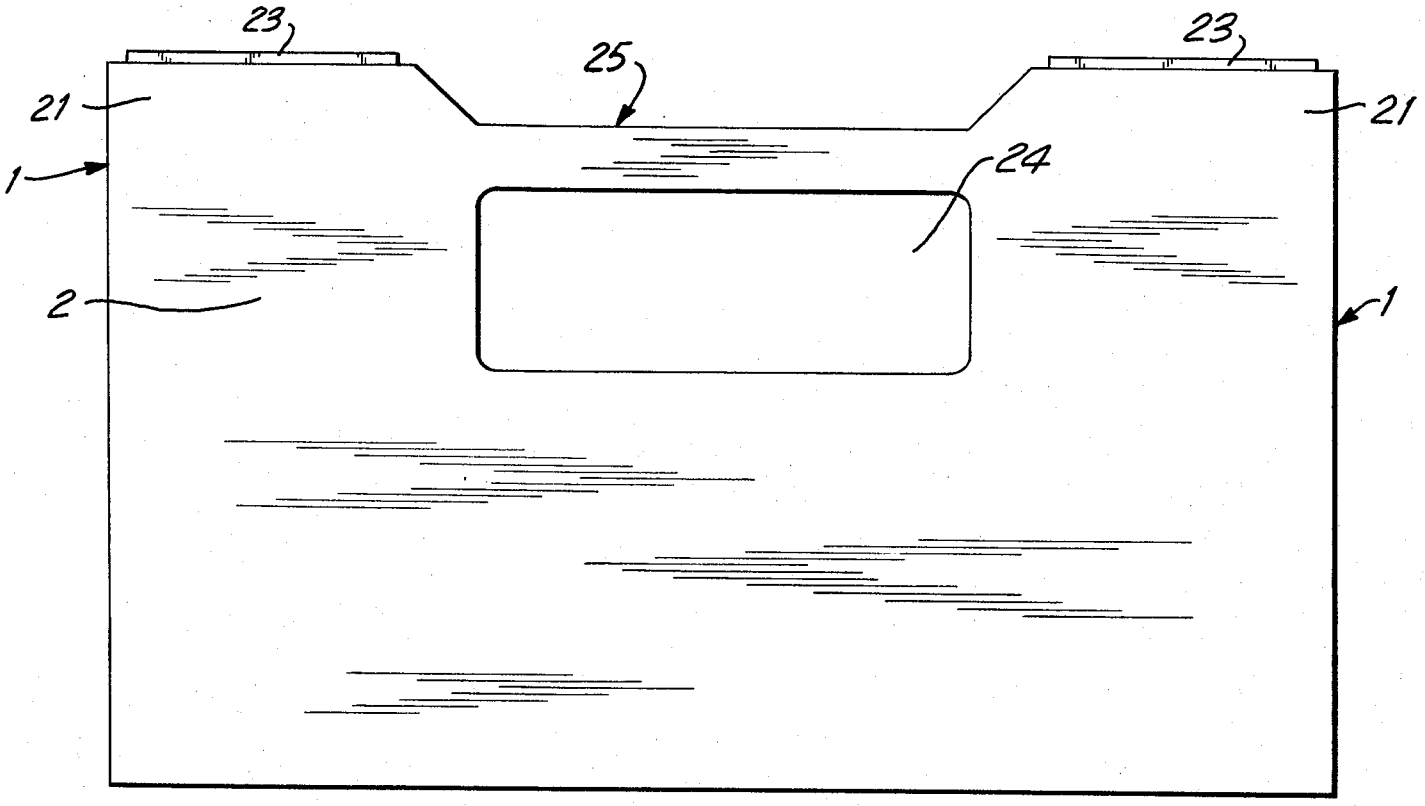

From FIG. 12, which shows a side elevation of the bottle case, it will be seen that the side wall surfaces 2 in the region of the corner columns extend up above the upper edge 22 of the side walls and terminate in an offset 23 which serves to center a bottle case stacked thereon. The offset 23 is closed at the top by a horizontal plate. This offset 23 and the horizontal plate thereon enter into the corner column of a bottle case stacked thereon to hold the bottle cases from slipping relative to one another. The side walls 2 are provided with handgrip openings 24 for lifting the bottle case.

When individual bottles or bottles in carriers such as those shown in FIGS. 8 to 11 are placed in the bottle case, they are supported by the surfaces 7, 10 and 32 and are positioned by the beads 15 and 16 so as to be closely spaced from one another and yet prevented from contact with one another. For example the spacing is of the order of 0.5 to 1.5 mm and preferably not greater than 1 mm. Except for the surfaces 7, 10 and 32, the bottoms of the bottle case are open.

A bottle case in accordance with the invention is conveniently molded in one piece of plastic or other suitable moldable material. By reason of its construction, it is strong and durable and maintains the bottles in a stable closely spaced condition.

I claim:

1. A rectangular plastic bottle case for individual bottles and bottles in bottle carrier of sheet material, comprising end walls, side walls, a bottom and means for positioning bottles in the case with the bottles closely spaced in straight lines parallel to the end walls, said bottle positioning means comprising columns projecting up from the bottom of the case, said columns being arranged in straight rows of pairs of columns, the two columns of each pair being spaced from one another to provide between them aligned spaces to receive a side of a bottle carrier, said columns being open V-shaped in cross-section, each of said columns being formed of two sides integrally joined with one another in an acute angle having its apex directed away from the space between the two columns of a pair, each side being bent inwardly along a longitudinal median line to provide two integral elongate wall portions disposed at an obtuse angle to one another, each column having three corners of which two are at edges of said sides adjacent said space between the two columns of a pair and one is at the apex of the acute angle in which the two sides join, and an enlarged rounded bead at each of said corners imparting strength to said columns and adapted to engage and precisely position bottles in said case.

2. A plastic bottle case according to claim 1, in which there is a long narrow median opening extending longitudinally in each of said sides of said columns.

3. A plastic bottle case according to claim 1, in which along each end wall of the case there is a row of like single columns in line said pairs of columns in said case and spaced from the end walls to provide a space for receiving a side of a bottle carrier with the apex of each column directed away from said space.

4. A plastic bottle case according to claim 1, in which along each side wall of the case there are pairs of vertically extending ribs projecting inwardly from said side walls, the ribs of each pair being equally spaced from a center line of said aligned spaces between columns.

5. A plastic bottle case according to claim 1, in which each of said columns is closed at its upper end with an inclined roof which slopes downwardly from said space between columns to said apex.

6. A plastic bottle case according to claim 1, in which at each corner of the case there are hollow double wall columns with an outer wall forming a portion of an outer wall of the case and an inner wall forming a portion of an inner wall of the case in corner portions only of the case, said columns extending above and below intermediate single thickness portions of side walls of the case.

7. A plastic bottle case according to claim 6, in which said hollow columns at the corners of the case are closed at their upper ends by flat tops which are offset inwardly by the thickness of said outer and inner walls of said corner columns so as to be received in lower ends of said hollow corner columns of a like superposed bottle case to maintain stacked bottle cases in stable condition.

8. A plastic bottle case according to claim 3, in which the bottom of said case comprises circular webs supporting said pairs of columns, semicircular webs supporting said single columns and straight webs connecting said circular webs and semicircular webs.

9. A plastic bottle case according to claim 1, in which said columns are spaced from one another to so that said enlarged rounded beads engage bottles in said case to position bottles in said case with a space of 0.5 to 1.5 mm between bottles.

10. A bottle packaging comprising bottles in bottle carriers and a rectangular plastic bottle case containing a plurality of said carriers with bottles therein, said bottle carriers being formed of a rectangular sheet of material bent to provide only a bottom and sides, the ends of said carrier being open, and said bottle casing comprising end walls, a bottom and means for positioning bottles in the case with the bottles closely spaced in straight lines parallel to the end walls, said bottle positioning means comprising columns projecting up from the bottom of the case, said columns comprising straight rows of pairs of columns parallel to said end walls, the two columns of each pair being spaced from one another to provide between them aligned spaces to receive sides of bottle carriers, and straight rows of single columns inside said end walls, said single columns being spaced from the respective end walls to provide between said single columns and the respective end walls spaces to receive sides of bottle carriers, each of said columns having three corners of which two are adjacent said respective spaces and the third is on a line bisecting and perpendicular to a line connecting said two corners, and enlarged rounded beads on said corners adapted to engage and position bottles in said case, said columns being spaced from one another to position bottles in said case with a space of 0.5 to 1.5 mm between bottles, the bottoms of said bottle carriers having openings to receive said columns of the case.

11. A bottle packaging according to claim 10 in which each of said columns is formed of two concave walls extending respectively from said two corners to said third corner and integrally joined with one another at said third corner, the facing sides of two columns of a pair being open.

12. A bottle packaging according to claim 10, in which said bottle case comprises a hollow column at each corner, each of said hollow columns comprising an outer wall and a curved, concave inner wall, side walls of said case between said columns being single thickness.

13. A bottle packaging according to claim 12, in which each of said bottle carriers comprises flaps at the ends of the bottom of the carrier, which flaps are folded up and pressed against the cylindrical part of end bottles so that corners of said bottle carriers are rounded.

14. A plastic bottle case according to claim 3, in which said case has four rows of said pairs of columns parallel to ends of said case with three pairs of columns in each row, and three of said single columns along each end of the case.

15. A bottle packaging according to claim 10, in which said bottle case has four rows of said pairs of columns parallel to ends of said case with three pairs of columns in each row, and three of said single column along each end of the case.

* * * * *